US010930298B2

(12) United States Patent
Kaskari et al.

(10) Patent No.: US 10,930,298 B2
(45) Date of Patent: Feb. 23, 2021

(54) MULTIPLE INPUT MULTIPLE OUTPUT (MIMO) AUDIO SIGNAL PROCESSING FOR SPEECH DE-REVERBERATION

(71) Applicant: SYNAPTICS INCORPORATED, San Jose, CA (US)

(72) Inventors: Saeed Mosayyebpour Kaskari, Irvine, CA (US); Francesco Nesta, Aliso Viejo, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 15/853,666

(22) Filed: Dec. 22, 2017

(65) Prior Publication Data

US 2018/0182411 A1 Jun. 28, 2018

Related U.S. Application Data

(60) Provisional application No. 62/438,848, filed on Dec. 23, 2016.

(51) Int. Cl.
*G10L 19/012* (2013.01)
*H04R 3/00* (2006.01)
(Continued)

(52) U.S. Cl.
CPC ..... *G10L 21/0264* (2013.01); *G10L 19/008* (2013.01); *G10L 21/0216* (2013.01);
(Continued)

(58) Field of Classification Search
None
See application file for complete search history.

(56) References Cited

U.S. PATENT DOCUMENTS 5,689,572 A * 11/1997 Ohki ..... G10K 11/178 381/71.3
2003/0206640 A1* 11/2003 Malvar ..... H03H 21/0012 381/93

(Continued)

FOREIGN PATENT DOCUMENTS

KR 10-1401120 5/2014

OTHER PUBLICATIONS

Ito et al., "Probabilistic Integration of Diffuse Noise Suppression and Dereverberation," 2014 IEEE International Conference on Acoustic, Speech and Signal Processing (ICASSP), May 2014, pp. 5167-5171, Florence, Italy.

(Continued)

*Primary Examiner* — Seong-Ah A Shin
(74) *Attorney, Agent, or Firm* — Haynes and Boone, LLP

(57) ABSTRACT

Audio signal processing for adaptive de-reverberation uses a least mean squares (LMS) filter that has improved convergence over conventional LMS filters, making embodiments practical for reducing the effects of reverberation for use in many portable and embedded devices, such as smartphones, tablets, laptops, and hearing aids, for applications such as speech recognition and audio communication in general. The LMS filter employs a frequency-dependent adaptive step size to speed up the convergence of the predictive filter process, requiring fewer computational steps compared to a conventional LMS filter applied to the same inputs. The improved convergence is achieved at low memory consumption cost. Controlling the updates of the prediction filter in a high non-stationary condition of the acoustic channel improves the performance under such conditions. The techniques are suitable for single or multiple channels and are applicable to microphone array processing.

19 Claims, 7 Drawing Sheets

(51) Int. Cl.

| | |
|---|---|
| ***G10L 21/0264*** | (2013.01) |
| ***G10L 19/008*** | (2013.01) |
| ***G10L 21/0216*** | (2013.01) |
| *G10L 21/0208* | (2013.01) |
| *G10L 25/78* | (2013.01) |

(52) U.S. Cl.
CPC .... *G10L 25/78* (2013.01); *G10L 2021/02082* (2013.01); *G10L 2021/02166* (2013.01); *H04R 3/005* (2013.01)

(56) References Cited

U.S. PATENT DOCUMENTS

| | | | | |
|---|---|---|---|---|
| 2006/0002546 | A1* | 1/2006 | Stokes, III | H04M 9/082 379/406.06 |
| 2008/0306739 | A1* | 12/2008 | Nakajima | G10L 21/028 704/270 |
| 2009/0214054 | A1 | 8/2009 | Fujii et al. | |
| 2010/0254555 | A1* | 10/2010 | Elmedyb | H04R 25/453 381/318 |
| 2011/0002473 | A1 | 1/2011 | Nakatani et al. | |
| 2011/0129096 | A1 | 6/2011 | Raftery | |
| 2012/0275613 | A1 | 11/2012 | Soulodre | |
| 2012/0310637 | A1* | 12/2012 | Vitte | G10L 21/0208 704/226 |
| 2012/0322511 | A1* | 12/2012 | Fox | H04R 3/005 455/570 |
| 2014/0126745 | A1* | 5/2014 | Dickins | H04R 3/02 381/94.3 |
| 2015/0016622 | A1* | 1/2015 | Togami | G10K 11/178 381/66 |
| 2015/0063581 | A1 | 3/2015 | Tani et al. | |
| 2016/0322064 | A1* | 11/2016 | Hsu | G10L 21/0208 |

OTHER PUBLICATIONS

Jukic et al., "Group Sparsity for MIMO Speech Dereverberation," 2015 IEEE Workshop on Applications of Signal Processing to Audio and Acoustics, Oct. 18-21, 2015, 5 Pages, New Paltz, New York.

Jukic et al., "Multi-channel Linear Prediction-Based Speech Dereverberation. With Sparse Priors," IEEE/ACM Transactions on Audio, Speech, and Language Processing, Sep. 2015, pp. 1509-1520, vol. 23, No. 9.

Keshavarz et al., "Speech-Model Based Accurate Blind Reverberation Time Estimation Using an LPC Filter," IEEE Transactions on Audio, Speech, and Language Processing, Aug. 2012, pp. 1884-1893, vol. 20, No. 6.

Mosayyebpour et al., "Single-Microphone Early and Late Reverberation Suppression in Noisy Speech," IEEE Transactions on Audio, Speech, and Language Processing, Feb. 2013, pp. 322-335, vol. 21, No. 2.

Mosayyebpour et al., "Single-Microphone LP Residual Skewness-Based for Inverse Filtering of the Room Impulse Response," IEEE Transactions on Audio, Speech, and Language Processing, Jul. 2012, pp. 1617-1632, vol. 20, No. 5.

Nakatani et al., "Speech Dereverberation Based on Variance-Normalized Delayed Linear Prediction," IEEE Transactions on Audio, Speech, and Language Processing, Sep. 2010, pp. 1717-1731, vol. 17, No. 7.

Schwartz et al., "Online Speech Dereverberation Using Kalman Filter and EM Algorithm," IEEE/ACM Transaction on Audio, Speech, and Language Processing, Feb. 2015, pp. 394-406, vol. 23, No. 2.

Togami et al., "Optimized Speech Dereverberation From Probabilistic Perspective for Time Varying Acoustic Transfer Function," IEEE Transactions on Audio, Speech, and Language Processing, Jul. 2013, pp. 1369-1380, vol. 21, No. 7.

Yoshioka et al., "Adaptive Dereverberation of Speech Signals with Speaker-Position Change Detection," 2009 IEEE International Conference on Acoustics, Speech and Signal Processing, Apr. 19-24, 2009, pp. 3733-3736.

Yoshioka, Takuya, "Dereverberation for Reverberation-Robust Microphone Arrays," 21st European Signal Processing Conference (EUSIPCO 2013), Jan. 2013, pp. 1-5) Marrakech, Morocco.

Yoshioka et al., "Generalization of Multi-Channel Linear Prediction Methods for Blind MIMO Impulse Response Shortening," IEEE Transactions on Audio, Speech, and Language Processing, Dec. 2012, pp. 2707-2720, vol. 20, No. 10.

Yoshioka et al., "Integrated Speech Enhancement Method Using Noise Suppression and Dereverberation," IEEE Transactions on Audio, Speech and Language Processing, Feb. 2009, pp. 231-246, vol. 17, No. 2.

* cited by examiner

MULTIPLE INPUT MULTIPLE OUTPUT (MIMO) AUDIO SIGNAL PROCESSING FOR SPEECH DE-REVERBERATION

CROSS-REFERENCE TO RELATED APPLICATIONS

This application claims the benefit of and priority to U.S. Provisional Patent Application No. 62/438,848 filed Dec. 23, 2016, and entitled "MULTIPLE INPUT MULTIPLE OUTPUT (MIMO) AUDIO SIGNAL PROCESSING FOR SPEECH DE-REVERBERATION," which is incorporated herein by reference in its entirety.

TECHNICAL FIELD

The present disclosure relates generally to speech enhancement and, more particularly, to reduction of reverberation in multiple signals (e.g., multichannel system) originating from a noisy, reverberant environment.

BACKGROUND

When speaking into an audio device—such as a smartphone, tablet, or laptop—from even a short distance (as opposed to speaking directly into the microphone), reflections of the speech signal can traverse various paths to the microphone of the device. These reflections of the signal (e.g., reverberations) can make the speech unintelligible. The effects of reverberation are often more noticeable in relatively empty or clear environments that lack objects, such as furniture and people, to absorb the sound reflections. The quality of VoIP (voice over internet phone) calls and the performance of many microphone array processing techniques, such as sound source localization, beam forming, and automatic speech recognition (ASR) used, e.g., for spoken commands and voicemail transcription, are generally degraded in reverberant environments.

A number of existing reverberation reduction methods suffer from a lack of processing speed (e.g., due to computational complexity of the methods) and an excess of memory consumption that make them impractical for real-time (e.g., "on-line") use for applications such as speech command recognition, voicemail transcription, and VoIP communication. For applications involving processing of signals from microphone arrays—such as sound source localization, reducing noise and interference in Multiple Input Multiple Output (MIMO) applications, beam forming, and automatic speech recognition—the performance of many microphone array processing techniques increases with the number of microphones used, yet existing de-reverberation methods typically do not produce the same number of de-reverberated signals as there are microphones in the array, limiting their applicability. Thus, there is a continued need in the art for faster, more memory-efficient, MIMO, and more computationally efficient de-reverberation solutions for audio signal processing.

SUMMARY

Systems and methods for Multiple Input Multiple Output (MIMO) audio signal processing are described herein. In various embodiments, systems and methods of adaptive de-reverberation are disclosed that use a least mean squares (LMS) filter that has improved convergence over conventional LMS filters, making embodiments practical for reducing the effects of reverberation for use in many portable audio devices, such as smartphones, tablets, and televisions, for applications like speech (e.g., command) recognition, voicemail transcription, and communication in general.

In one embodiment, a frequency-dependent adaptive step size is employed to speed up the convergence of the LMS filter process, such that the process arrives at its solution in fewer computational steps compared to a conventional LMS filter. In one embodiment, the improved convergence is achieved while retaining the computational efficiency, in terms of low memory consumption cost, that is characteristic of LMS filter methods compared to some other adaptive filtering methods. In one embodiment, a process of controlling the updates of the prediction filter of the LMS method using the voice activity detection in a high non-stationary condition of the acoustic channel improves the performance of the de-reverberation method under such conditions.

In one or more embodiments, systems and methods provide processing of multichannel audio signals from a plurality of microphones, each microphone corresponding to one of a plurality of channels, to produce de-reverberated enhanced output signals with the same number of de-reverberated signals as microphones.

One or more embodiments disclose a method including a subband analysis to transform the multichannel audio signals on each channel from time domain to under-sampled K-subband frequency domain signals, wherein K is the number of frequency bins, each frequency bin corresponding to one of K subbands, buffering, with a delay, to store for each channel a number $L_k$ of frames for each frequency bin, estimating online (e.g., in an online manner, in other words in real time) a prediction filter at each frame using an adaptive method for online (real-time) convergence, performing a linear filtering on the K-subband frequency domain signals using the estimated prediction filter, and applying a subband synthesis to reconstruct the K-subband frequency domain signals to time-domain signals on the plurality of channels.

The method may further include estimating a variance $\sigma(l,k)$ of the frequency-domain signals for each frame and frequency bin, and following the linear filtering, applying a nonlinear filtering using the estimated variance to reduce residual reverberation and noise after the linear filtering. Estimating the variance may comprise estimating a variance of reflections, a reverberation component variance, and a noise variance.

In various embodiments, the method may further include estimating the variance of reflections using a previously estimated prediction filter, estimating the reverberation component variance using a fixed exponentially decaying weighting function with a tuning parameter to optimize the prediction filter by application, and estimating the noise variance using single-microphone noise variance estimation for each channel. The method may further include performing linear filtering under control of a tuning parameter to adjust an amount of de-reverberation. In one embodiment, the adaptive method comprises using a least mean squares (LMS) process to estimate the prediction filter at each frame independently for each frequency bin, and using an adaptive step-size estimator that improves a convergence rate of the LMS process compared to using a fixed step-size estimator. The method may further comprise using voice activity detection to control the update of the prediction filter under noisy conditions.

In various embodiments, an audio signal processing system comprises a hardware system processor and a non-transitory system memory including a subband analysis module operable to transform a multichannel audio signal from a plurality of microphones, each microphone corresponding to one of a plurality of channels, from time domain to frequency domain as subband frames having a number K of frequency bins, each frequency bin corresponding to one of K subbands of a plurality of under-sampled K-subband frequency domain signals, a buffer, having a delay operable to store for each channel a number of subband frames for each frequency bin, a prediction filter operable to estimate in online manner a prediction filter at each subband frame using an adaptive method, a linear filter operable to apply the estimated prediction filter to a current subband frame, and a subband synthesizer operable to reconstruct the K-subband frequency domain signals from the current subband frame into a number of time-domain de-reverberated enhanced output signals on the plurality of channels, wherein the number of time-domain de-reverberated signals is the same as the number of microphones.

In various embodiments, the system may further include a variance estimator operable to estimate a variance of the K-subband frequency-domain signals for each frame and frequency bin, and a nonlinear filter operable to apply a nonlinear filter based on the estimated variance following the linear filtering of the current subband frame. The variance estimator may be further operable to estimate a variance of early reflections, a reverberation component variance, and a noise variance.

In various embodiments, the prediction filter is further operable to use a least mean squares (LMS) process to estimate the prediction filter at each frame independently for each frequency bin. The system may also include an adaptive step-size estimator that improves a convergence rate of LMS compared to using a fixed step-size estimator. The system may also include a voice activity detector to control the update of the prediction filter.

In one embodiment, the linear filter is operable to operate under control of a tuning parameter that adjusts an amount of de-reverberation applied by the estimated prediction filter to the current subband frame. In one embodiment, estimating the variance of early reflections comprises using a previously estimated prediction filter, estimating the reverberation component variance comprises using a fixed exponentially decaying weighting function with a tuning parameter, and estimating the noise variance comprises using single-microphone noise variance estimation for each channel.

In various embodiments, a system includes a non-transitory memory storing one or more subband frames and one or more hardware processors in communication with the memory and operable to execute instructions to cause the system to perform operations. The system may be operable to perform operations comprising estimating a prediction filter online at each subband frame using an adaptive method of least mean squares (LMS) estimation, performing a linear filtering on the subband frames using the estimated prediction filter, and applying a subband synthesis to reconstruct the subband frames into time-domain signals on a plurality of channels.

In various embodiments, the system is further operable to use an adaptive step-size estimator based on values of a gradient of a cost function or an adaptive step-size estimator that varies inversely to an average of values of a gradient of a cost function.

The scope of the invention is defined by the claims, which are incorporated into this section by reference. A more complete understanding of embodiments of the invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

Figure 1:
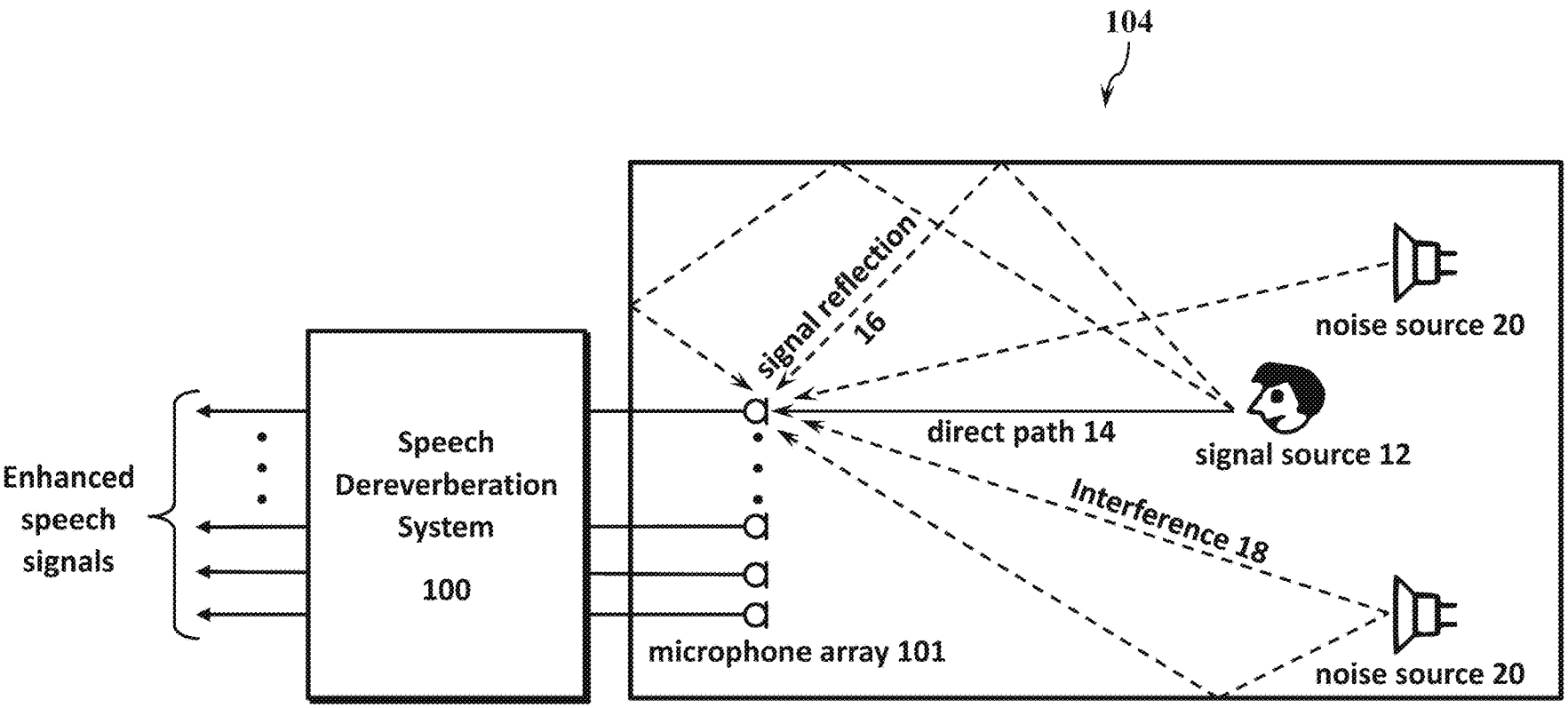
FIG. 1 is a diagram of an environment in which audio signals and noise are received by a microphone array connected to a system for MIMO audio signal processing for speech de-reverberation, in accordance with one or more embodiments.

Embodiments of adaptive de-reverberation systems and method are disclosed. In various embodiments, an adaptive de-reverberation system uses a least mean squares (LMS) filter that achieves improved convergence over conventional LMS filters, making the embodiments practical for reducing the effects of reverberation for use in many portable audio devices, such as smartphones, tablets, and televisions, for applications like speech (e.g., command) recognition, voicemail transcription, and communication in general. In one embodiment, an frequency-dependent adaptive step size is employed to speed up the convergence of the LMS filter process, meaning that the process arrives at its solution in fewer computational steps compared to a conventional LMS filter. In another embodiment, an inventive process of controlling the updates of the prediction filter of the LMS method in a high non-stationary condition of the acoustic channel improves the performance of the de-reverberation method under such conditions.

In various embodiments, the improved convergence is achieved while retaining the computational efficiency, in terms of low memory consumption cost, that is characteristic of LMS filter methods compared to some other filter methods. For example, LMS methods can have a much lower cost in terms of memory consumption, because they do not require a correlation matrix as used with other methods such as recursive least squares (RLS) filter and Kalman filter methods. But LMS methods generally have a convergence rate less than other advanced methods like Kalman filtering and RLS filtering. Embodiments thus provide an LMS filter with improved speed of convergence that is closer to that of comparable Kalman filtering and RLS filtering but with memory consumption cost that is reduced by comparison. For example, embodiments feature a new adaptive de-reverberation using an LMS method that does not require a correlation matrix—as is the case with RLS and Kalman filter methods—and so the memory consumption is much lower.

The adaptive de-reverberation using an LMS filter according to one or more embodiments of this disclosure, by providing an LMS filter with a speed of convergence that is closer to that of comparable Kalman filtering and RLS filtering but with memory consumption cost that is reduced by comparison, improves the technology of audio signal processing used by many types of devices including smartphones, tablets, televisions, personal computers, and embedded devices such as car computers and audio codecs used in phones and other communication devices.

One application of de-reverberation is for speech enhancement in a noisy, reverberant environment. Such speech enhancement can be difficult to achieve because of various intrinsic properties of the speech signals, the noise signals, and the acoustic channel. For example, (i) speech signals are colored (e.g., the signal power varies depending on frequency) and non-stationary (e.g., statistical properties, such as average volume of the speech signal, change over time), (ii) noise signals (e.g., the environmental noise) can change dramatically over time, and (iii) the impulse response of an acoustic channel (e.g., room acoustics) is usually very long (e.g., enhancing the effect of reverberation) and has non-minimum phase (e.g., there is no direct inversion for the impulse response).

Conventional techniques for de-reverberation processing are typically application-specific in a way that limits or precludes their real-time or on-line use for audio devices and audio processing found in, for example, VoIP, hearing aids, smartphones, tablets, televisions, laptops, videoconferencing, and other embedded devices (processors) used in products such as appliances and automobiles. For example, the respective computational complexity for each technique may cause it to be impractical for real-time, on-line processing.

A number of other examples of limitations of the prior art techniques for de-reverberation processing are as follows. The memory consumption of many of the techniques is high and not suitable for embedded devices which require memory efficient techniques due to constraints on memory in such devices. In a real-world environment, the reverberant speech signals are usually contaminated with non-stationary additive background noise (e.g., non-constant or disruptive noise) that can greatly deteriorate the performance of de-reverberation techniques that do not explicitly consider the non-stationary noise in their model. Many of the prior art de-reverberation methods are batch approaches (e.g., imposing or incurring a delay or latency between input and output) that require a considerable amount of input data to provide good performance results. In most applications such as VoIP and hearing aids, however, there should not be any latency. Many of the prior art de-reverberation techniques do not produce the same number of de-reverberated signals as microphones, contrary to the requirements of many microphone array processing techniques for which the performance increases with the number of microphones. Many of the prior art de-reverberation techniques do not conserve the time differences of arrival (TDOAs) at (multiple) microphone positions, contrary to the requirements of many source localization techniques that are explicitly or implicitly based on time differences of arrival at the microphone positions. Many of the prior art de-reverberation techniques require knowledge (e.g., an input or configuration) of the number of sound sources, required because it is often difficult to estimate the correct number of sources with blind processing.

Embodiments as described herein provide qualities and features that address the above limitations, making them useful for a great variety of different applications. For example, processes that implement the embodiments can be designed to be memory efficient and speed efficient requiring, for example, less memory and lower processing speeds to order to be able to run with no latency (e.g., perform in real-time), which makes the embodiments desirable for applications like VoIP.

De-reverberation according to one or more embodiments of the present disclosure is robust to non-stationary noise, performs well in high reverb conditions with high reverberation time, can be both single-channel and multi-channel, and can be adapted for the case of more than one single-source. In one embodiment, by skipping the nonlinear filtering part of the method (which is used to further reduce noise and residual reverberation after the linear filtering), the processing can be converted into linear processing, which may be essential for some applications requiring linearity. In one embodiment, an adaptive filter for de-reverberation takes additive background noise into account, adaptively estimating the power spectral density (PSD) of the noise to adaptively estimate the prediction filter to provide real-time performance for on-line use.

The Multiple Input Multiple Output (MIMO) feature of one or more embodiments provides several capabilities, including ready integration into other modules for performing noise reduction or source location. In one embodiment, a blind method—e.g., one that processes a set of source signals from a set of mixed signals, without aid of information about the source signals or their mixing process—uses multi-channel input signals for shortening a room impulse response (RIR) between a set of sources of unknown number. The method uses subband-domain multi-channel linear prediction filters, and estimates the filter for each frequency band independently. One notable capability of the method is that it can conserve time differences of arrival (TDOA) at microphone positions as well as the linear relationship between sources and microphones. Such capability may be required for subsequent processing for localization and reducing noise and interference. In addition, the method can yield as many de-reverberated signals as microphones by estimating the prediction filter for each microphone separately.

FIG. 1 illustrates an environment in which audio signals and noise are received by a microphone array 101 connected to a speech de-reverberation system 100 configured for MIMO audio signal processing, in accordance with one or more embodiments. FIG. 1 shows a signal source 12 (e.g., person speaking) and the microphone array 101 connected to provide signals to the speech de-reverberation system 100. The signal source 12 and microphones 101 may be situated in an environment 104 that transmits the signals and noise. Such an environment may be any environment capable of transmitting sound such as a city street, a restaurant interior, or a room of a dwelling. For purposes of illustration environment 104 is illustrated as an enclosure with walls (e.g., surfaces in the environment 104 that reflect sound waves). Microphone array 101 may include one or more microphones (e.g., audio sensors) and the microphones may be, for example, components of one or more consumer electronic devices such as smartphones, tablets, or playback devices.

As seen in FIG. 1, signals received by microphone array 101 may include a direct path signal 14 from the signal source 12, reflected signals 16 (e.g., signal reflections off the walls of enclosure 104) from the signal source 12, and noise 18 (also referred to as interference) from various noise sources 120 which can be received at microphone array 101 both directly and as reflections as shown in FIG. 1. De-reverberation system 100 may process the signals from microphone array 101 and produce an output signal, e.g., enhanced speech signals, useful for various purposes as described above.

In real-world environments, a recorded speech signal is noisy and this noise can degrade the speech intelligibility for VoIP application, and it can decrease the speech recognition performance of devices such as phones and laptops. When microphone arrays (e.g., microphone array 101) are employed instead of a single microphone, it is easier to solve the problem of interference noise using beam forming methods that can exploit the spatial diversity to better detect or extract desired source signals and to suppress the unwanted interference. Beam forming methods represent a class of multichannel signal processing methods that perform a spatial filtering which points a beam of increased sensitivity to desired source locations while suppressing signals originating from all other locations. For these beam forming methods, the noise suppression is only sufficient in case the signal source is close to the microphones (near-field scenario). However, the problem can be more severe when the distance between source and microphones is greater, as shown in FIG. 1.

In the example shown in FIG. 1, the signal source is far from the microphones 101 and the signals that are collected by the microphones 101 are not only the direct path but also the signal reflections off the walls and ceiling. The collected signals also include the noise source signals which originate from around the signal source. The quality of VoIP calls and the performance of many microphone array processing techniques, such as sound source localization, beam forming, and automatic speech recognition (ASR) are sensibly degraded in these reverberant environments. This is because reverberation blurs the temporal and spectral characteristics of the direct sound. Speech enhancement in a noisy reverberant environment can be difficult to achieve because, as more fully described above: (i) speech signals are colored and non-stationary, (ii) noise signals can change dramatically over time, and (iii) the impulse response of an acoustic channel is usually very long and has non-minimum phase. The length of the impulse response (e.g., of channel 104) depends on the reverberation time and many methods fail to work in channels with a high reverberation time. Various embodiments of de-reverberation system 100 provide a noise-robust, multi-channel, speech de-reverberation system to reduce the effect of reverberation while producing a multichannel estimation of the de-reverberated speech signal.

Figure 2:
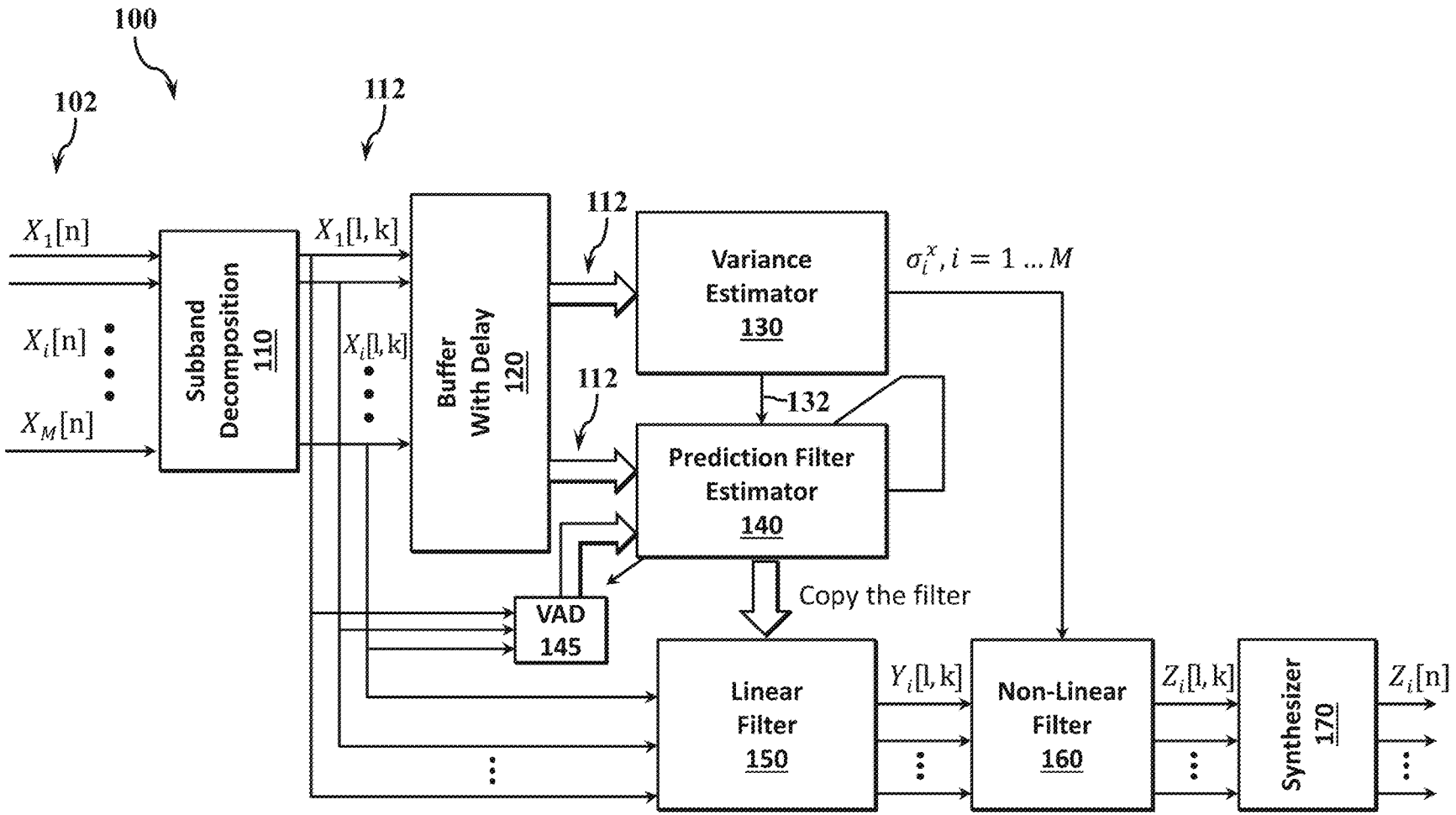
FIG. 2 is a system block diagram illustrating a MIMO audio signal processing system for speech de-reverberation, in accordance with one or more embodiments.

FIG. 2 illustrates a multiple input multiple output (MIMO) speech de-reverberation audio signal processing system 100, in accordance with one or more embodiments. System 100 may be part of any electronic device, such as an audio codec, smartphone, tablet, television, or computer, for example, or systems incorporating low power audio devices, such as smartphones, tablets, and portable playback devices.

System 100 may include a subband analysis (subband decomposition) module 110 connected to a number of input audio signal sources, such as microphones, e.g., microphone array 101, or other transducer or signal processor devices, each source corresponding to a channel, to receive time domain audio signals 102 for each channel. Subband analysis module 110 may transform the time-domain audio signals 102 into subband frames 112 in the frequency domain. Subband frames 112 may be provided to buffer 120 with delay that stores the last $L_k$ subband frames 112 for each channel, where $L_k$ is further described below.

Buffer 120 may provide the frequency domain subband frames 112 to variance estimator 130. Variance estimator 130 may estimate the variance of the current subband frame 112 as each subband frame 112 becomes current. The variance of a subband frame 112 may be used for prediction filter estimation and nonlinear filtering. The estimated variances 132 may be provided from the variance estimator 130 to prediction filter estimator 140.

Buffer 120 also may provide the frequency domain subband frames 112 to prediction filter estimator 140. Prediction filter estimator 140 may receive the variance 132 of the current subband frame 112 from variance estimator 130. Prediction filter estimator 140 may implement a fast-converging, adaptive online (e.g., real-time) prediction filter estimation. A voice activity detector (VAD) 145 may be used to provide control in noisy environments over the prediction filter estimator 140 based on input to VAD 145 of subband frames 112 and providing an output 136 to filter prediction filter estimator 140. Linear filter 150 may apply the prediction filter estimation from prediction filter estimator 140 to subband frames 112 to reduce most of the reverberation from the source signal. Nonlinear filter 160 may be applied to the output of linear filter 150, as shown, to reduce the residual reverberation and noise. Synthesizer 170 may be applied to the output of nonlinear filter 160, transforming the enhanced subband frequency domain signals to time domain signals.

As shown in FIG. 2, the time domain audio input signal 102 for the i-th channel is denoted by $x_i[n]$ (i=1 . . . M) where M is the number of microphones. As shown in FIG. 2, the input signals 102 are first transformed, at subband analysis 110, into subband frequency domain signals 112, denoted by $X_i(l,k)$ where l is the frame index and k=1 . . . K is the frequency index with K bands. The input signal is modeled as:

$$X_i(l,k) = Z_i(l,k) + R_i(l,k) + \upsilon_i(l,k) \tag{1}$$

$$R_i(l,k) = \sum_{m=1}^{M} \sum_{l'=0}^{L_k-1} X_m(l-D-l',k) g_m^{i*}(l',k)$$

$$D \geq 0 \rightarrow \text{prevent whitening the processed speech}$$

$$g_m^i(l,k) \rightarrow \text{complex value prediction filter for } m\text{-}th \text{ channel}$$

where $Z_i(l,k)$ is the early reflection (or direct path or clean speech signal, see FIG. 1) of the signal source which is the desired signal. $R_i(l,k)$ and $\nu_i(l,k)$ are the late reverberation and the noise components, respectively, of the input signal $X_i(l,k)$. As seen in equations (1), the late reverberation is estimated linearly by complex prediction filters $g_m^{i(l)}(l,k)$ at the l-th frame with length $L_k$ for each frequency band. D is the delay to prevent the processed speech from being excessively whitened while it leaves the early reflection distortion in the processed speech.

Figure 3:
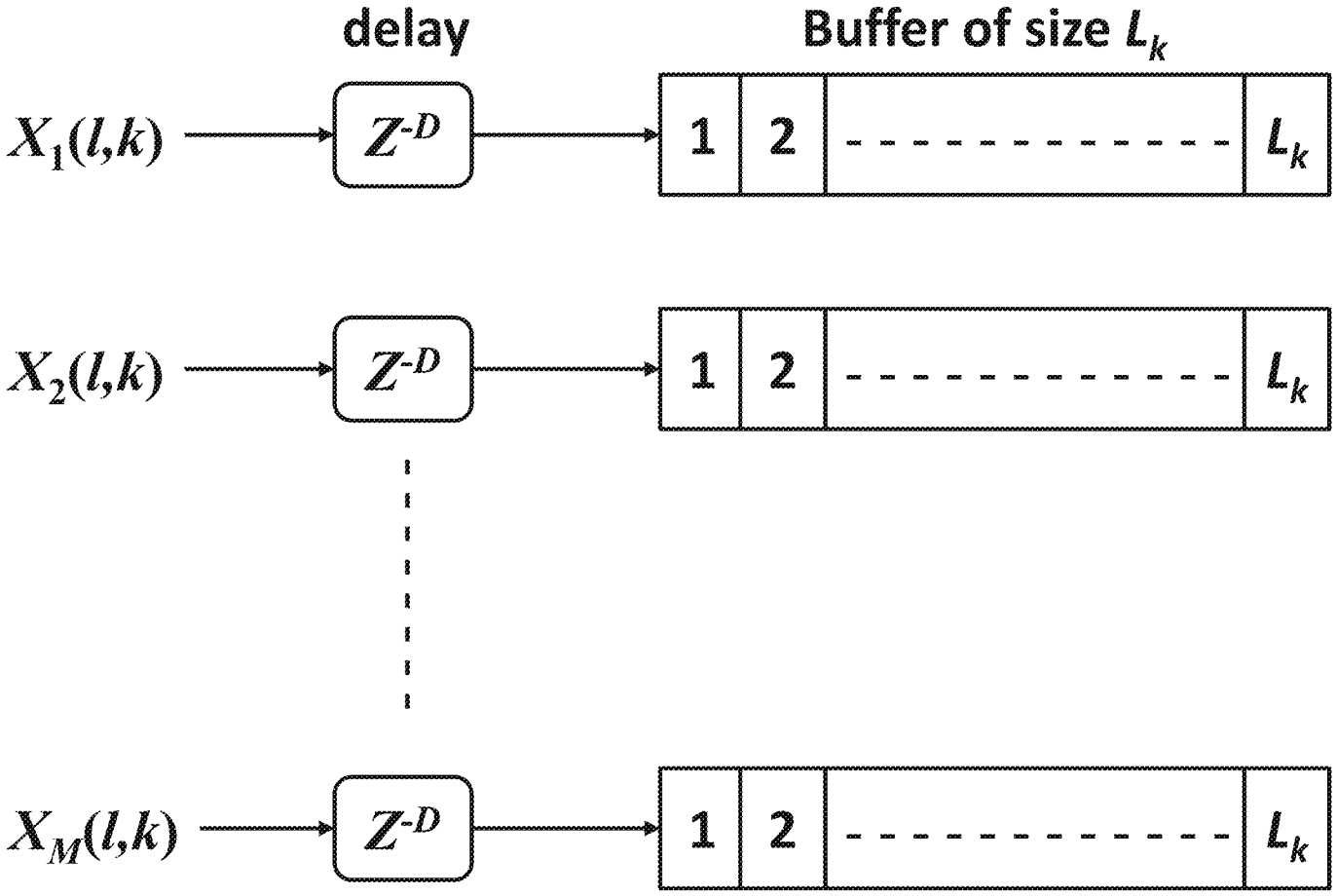
FIG. 3 is a general structure diagram of a subband signal decomposition buffer for a MIMO audio signal processing de-reverberation system, in accordance with one embodiment.

FIG. 3 illustrates in more detail the subband signal decomposition buffer 120 shown in FIG. 2. As seen in FIG.

2, the input signal $X_i(l,k)$ (e.g., subband frames 112) for each microphone after the subband decomposition at subband analysis 110 is connected to the buffer 120 with delay D. The subband frame 112 is shown in FIG. 3 for frame l and frequency bin k. The buffer size for the k-th frequency bin is $L_k$. As shown in FIG. 3, the most recent $L_k$ frames of the signal with a delay of D will be kept in this buffer 120 for each channel i (i=1 . . . M).

Returning to FIG. 2, variance estimation (via variance estimator 130) is performed on the subband frames 112. In one embodiment, the variance estimation is performed in accordance with one or more of the systems and methods disclosed in co-pending U.S. Provisional Patent Application No. 62/438,860, titled, "ONLINE DEREVERBERATION ALGORITHM BASED ON WEIGHTED PREDICTION ERROR FOR NOISY TIME-VARYING ENVIRONMENTS," by Saeed Mosayyebpour, Francesco Nesta, and Trausti Thormundsson, which is incorporated herein by reference in its entirety. As disclosed in the co-pending application, it may be assumed that the received speech spectrum has a Gaussian probability distribution function with mean $\mu_i(l,k)$ and variance $\sigma(l,k)$ for frame l and frequency bin k as given below:

$$\mu_i(l,k) = 0 + \sum_{m=1}^{M}\sum_{l'=0}^{L_k-1} X_m(l-D-l',k)g_m^{i*}(l',k) + 0 \tag{2}$$

$$\sigma_i(l,k) = \sigma(l,k) = \sigma^c(l,k) + \sigma^r(l,k) + \sigma^v(l,k)$$

where $\sigma^c$ (l,k), $\sigma^r$ (l,k) and $\sigma^v$(l,k) are the variances, respectively, for early reflections (also referred to as "clean speech"), reverberation component, and noise. The equation $\sigma_i=\sigma(l,k)$ is assumed to be identical for each of the i channels, hence the subscript i is suppressed. As seen in equations (2), it is assumed that the early reflections and the noise have zero mean. The variance of early reflections $\sigma^c(l,k)$ may be approximated by zeros, using:

$$\sigma^c(l,k) = \frac{1}{M}\sum_{i=1}^{M}\left|X_i(l,k) - \sum_{m=1}^{M}\sum_{l'=0}^{L_k-1} X_m(l-D-l',k)g_m^{i*}(l',k)\right|^2. \tag{3}$$

As further disclosed in the co-pending application, the reverberation component variance $\sigma^r$ (l,k) is estimated using fixed weights. The noise variance $\sigma^v$(l,k) may be estimated using an efficient real-time single-channel method and the noise variance estimations may be averaged over all the channels to obtain a single value for noise variance $\sigma^v$(l,k).

Referring again to FIG. 2, prediction filter estimator 140 is performed on the subband frames 112 using the variance estimates 132 provided by variance estimator 130. The prediction filter estimator 140 is based on maximizing the logarithm probability distribution function of the received spectrum, i.e. using maximum likelihood (ML) estimation and the probability distribution function is Gaussian with the mean and variance that are given in equations (2). An embodiment of the prediction filter estimation is disclosed in the co-pending application, discussed above. This is equal to minimizing the following cost function:

$$\text{cost function} = L(X_i(l,k), l=1 \ldots T \mid g_m^i(l,k)) = \sum_{l=1}^{T}\left\{\log|\sigma(l,k)| + \left(\frac{|X_i(l,k)-\mu_i(l,k)|^2}{\sigma(l,k)}\right)\right\} \tag{4}$$

$$\mu_i(l,k) = \sum_{m=1}^{M}\sum_{l'=0}^{L_k-1} X_m(l-D-l',k)g_m^{i*}(l',k).$$

The recursive least squares (RLS) method has been used to estimate the optimum prediction filter in an online manner (e.g., in real-time for online application) adaptively. Despite its efficiency and fast convergence, the RLS method requires correlation matrix to be used and for the case of multi-channel with long prediction filters which is important to capture long correlation, it cannot be deployed into the embedded devices with memory restriction. Also, the RLS method can converge fast and deep so that when the RIR is changed due to speaker or source movement, it requires longer time to converge to new filters. So, the RLS-based solution is not practical for many applications which have memory limitation and it has changing environments.

According to one embodiment, a novel method based on Least Mean Square estimation (LMS) is used. In general, the LMS based method does not have as fast a convergence rate as RLS, and so the LMS method cannot be used in time-varying environments. The novel method according to one embodiment is used to calculate an adaptive step-size for the LMS solution to make it as fast as RLS, but the LMS solution requires far less memory and can also react faster to sudden changes.

Using the adaptive LMS-based solution, the mean in equations (4) can be rewritten in vector form as:

$$\overline{X}(l,k)=[X_1(l-D,k), \ldots, X_1(l-D-L_k+1,k), \ldots, X_M(l-D,k), \ldots, X_M(l-D-L_k+1,k)]^T g_i(k)=[g_1^i(0,k), \ldots, g_1^i(L_k-1,k), g_M^i(0,k), g_M^i(L_k-1,k)]^T, \mu_i(l,k)=\overline{X}(l,k)^T g_i^*(k) \tag{5}$$

Where $g_i(k)$ is the prediction filter for frequency band k and the i-th channel and (•)* denotes complex conjugate.

As disclosed in the co-pending application, the cost function can be simplified as:

$$\text{cost function} = L(X_i(l,k), l=1 \ldots T \mid g_m^i(l,k)) = \sum_{l=1}^{T}\left\{\log|\sigma(l,k)| + \left(\frac{\left|X_i(l,k)-\overline{X}(l,k)^T g_i^*(k)\right|^2}{\sigma(l,k)}\right)\right\}. \tag{6}$$

In order to estimate $g_i^{(l)}(k)$ in an online manner for the l-th frame, it should be initialized by zero values for all the frequencies and channels, and the gradient $\nabla(L(X_i(l,k)))$ of the cost function given in equations (6), which is a vector of $L_k$*M numbers, should be computed. The update rule using the LMS method can be written as follows.

$$g_i^{(l)}(k)=g_i^{(l)}(k)-\eta\nabla(L(X_i(l,k))) \tag{7},$$

where η is a fixed step-size and $g_i^{(l)}(k)$ denotes prediction filter at l-th frame. Now the gradient $\nabla(L(X_i(l,k)))$ of the cost function in equations (6) may be computed.

$$\nabla(L(X_i(l,k))) = E(l,k)\overline{X}(l,k) \tag{8}$$

$$E(l,k) = \frac{X_i(l,k)-\overline{X}(l,k)^T g_i^{(l-1)*}(k)}{\sigma(l,k)}.$$

Although $\eta$ is referred to here as a fixed step-size for purposes of illustrating the example, the step-size $\eta$ need not be fixed and can be adaptively determined, based on values of the gradient, for example, in order to improve the performance of the LMS methods.

Figure 4:
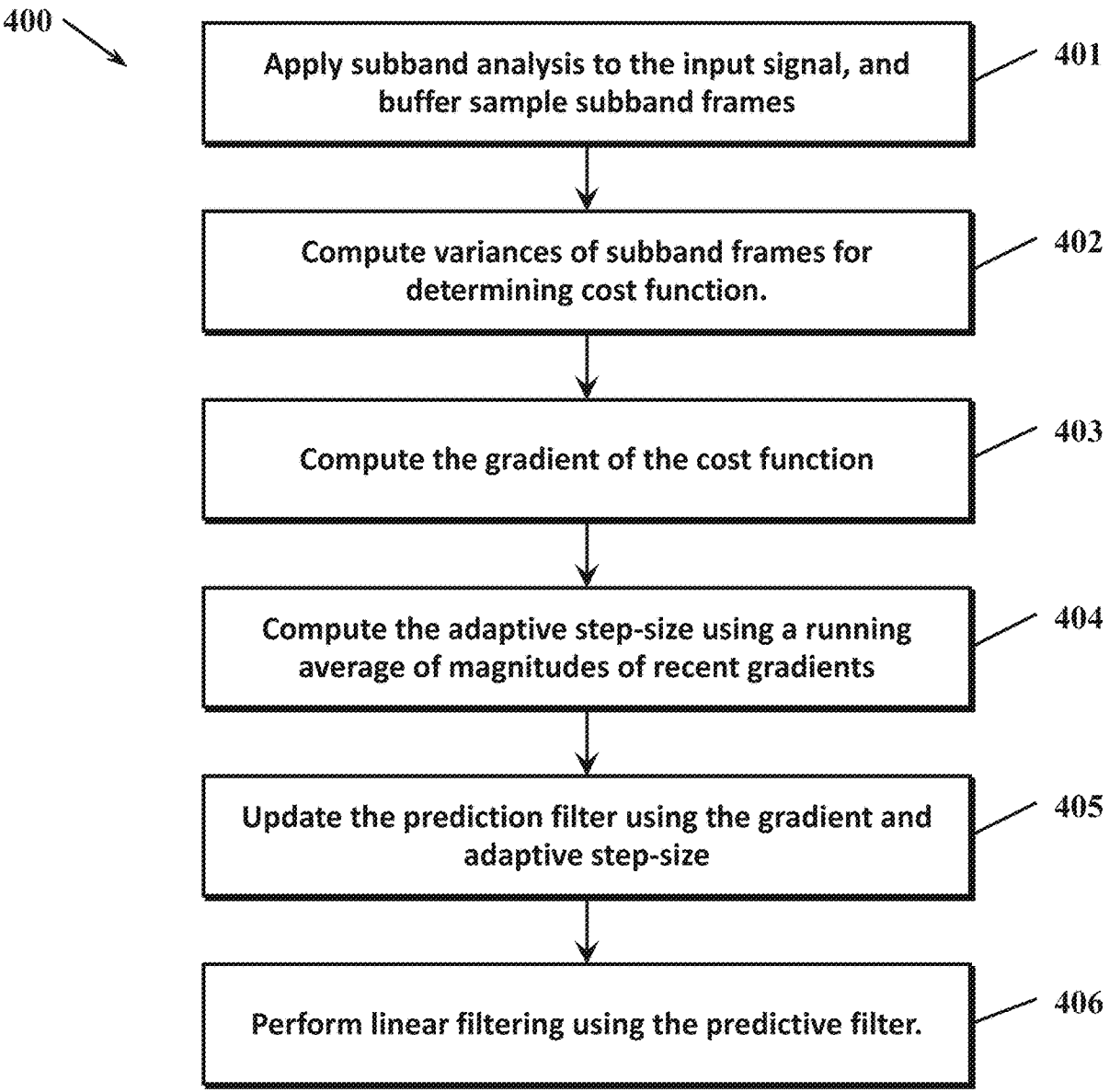
FIG. 4 is a flow diagram of a method of MIMO audio signal de-reverberation processing, using a novel adaptive filtering according to an embodiment.

FIG. 4 is a flow diagram of a method 400 of MIMO audio signal de-reverberation processing, using a novel adaptive filtering according to one or more embodiments. Method 400 may include an act 401 of applying subband analysis to the input signal 102, and buffering sample subband frames 112, as described above. Method 400 may include an act 402 of computing variances (e.g., as in equations (2) and (3)) of subband frames 112 for determining the cost function, e.g., as in equations (4) and (6). At acts 403, 404, and 405 predictive filter weights $g_i^{(l)}(k)$ may be estimated (e.g., predictive filter estimator 140 in FIG. 2), as described above and further described below.

At act 403, the gradient of the prediction filter is computed and it is initialized by zero. Equation (7) with an adaptive step-size (l,k) can be rewritten as:

$$g_i^{(l)}(k)=g_i^{(l)}(k)-\eta(l,k)\nabla(L(X_i(l,k))) \quad (9).$$

At act 404, the adaptive step-size $\eta(l,k)$ by dividing a sufficiently low step-size (i.e., $\eta_0$) by a running average of the magnitudes of recent gradients (the smoothed root mean square (RMS) average of magnitudes of gradients). Updating the prediction filter using the estimated gradient and the adaptive step-size proceeds at act 405. In the case of a large smoothed RMS average of gradients, the total value of the step-size will be low to avoid divergence, and likewise, when the smoothed RMS average of gradients value becomes small, then the step-size will be increased to speed up the convergence.

At act 404, to compute the smoothed RMS average of gradients, a buffer ($G_i^{(l)}(k)$) of K values (corresponding to the number of frequency bands) for each channel i may store the values and may be initialized to zero. Each smoothed RMS average gradient ($G_i^{(l)}(k)$) may be updated as follows.

$$\nabla(L(X_i(l,k))) = \left[\Lambda_{ilk}^{(1)} \quad \Lambda_{ilk}^{(2)} \quad \ldots \quad \Lambda_{ilk}^{(L_k*M)}\right]^T \quad (10)$$

$$G_i^{(l)}(k) = \rho G_i^{(l-1)}(k) + \frac{(1-\rho)}{L_k * M}\nabla^H(L(X_i(l,k)))\nabla(L(X_i(l,k))),$$

where $\rho$ is a smoothing factor which is close to one and $(\bullet)^H$ denotes transpose conjugate.

The adaptive step-size $\eta(l,k)$ can be calculated as:

$$\eta(l,k) = \frac{\eta_0}{\sqrt{G_i^{(l)}(k)+\varepsilon}}, \quad (11)$$

where $\varepsilon$ is a small value on the order of 1e-6 (e.g., 0.000001) to avoid division by zero, and $\eta_0$ is the fixed step-size or initial step-size.

At act 405, the prediction filter is updated as given in (9) using (8), (10) and (11).

At act 406, the optimal filter weights may be passed to linear filter 150 and used to perform linear filtering of the subband frames 112, which are also passed to linear filter 150 as seen in FIG. 2.

Figure 5:
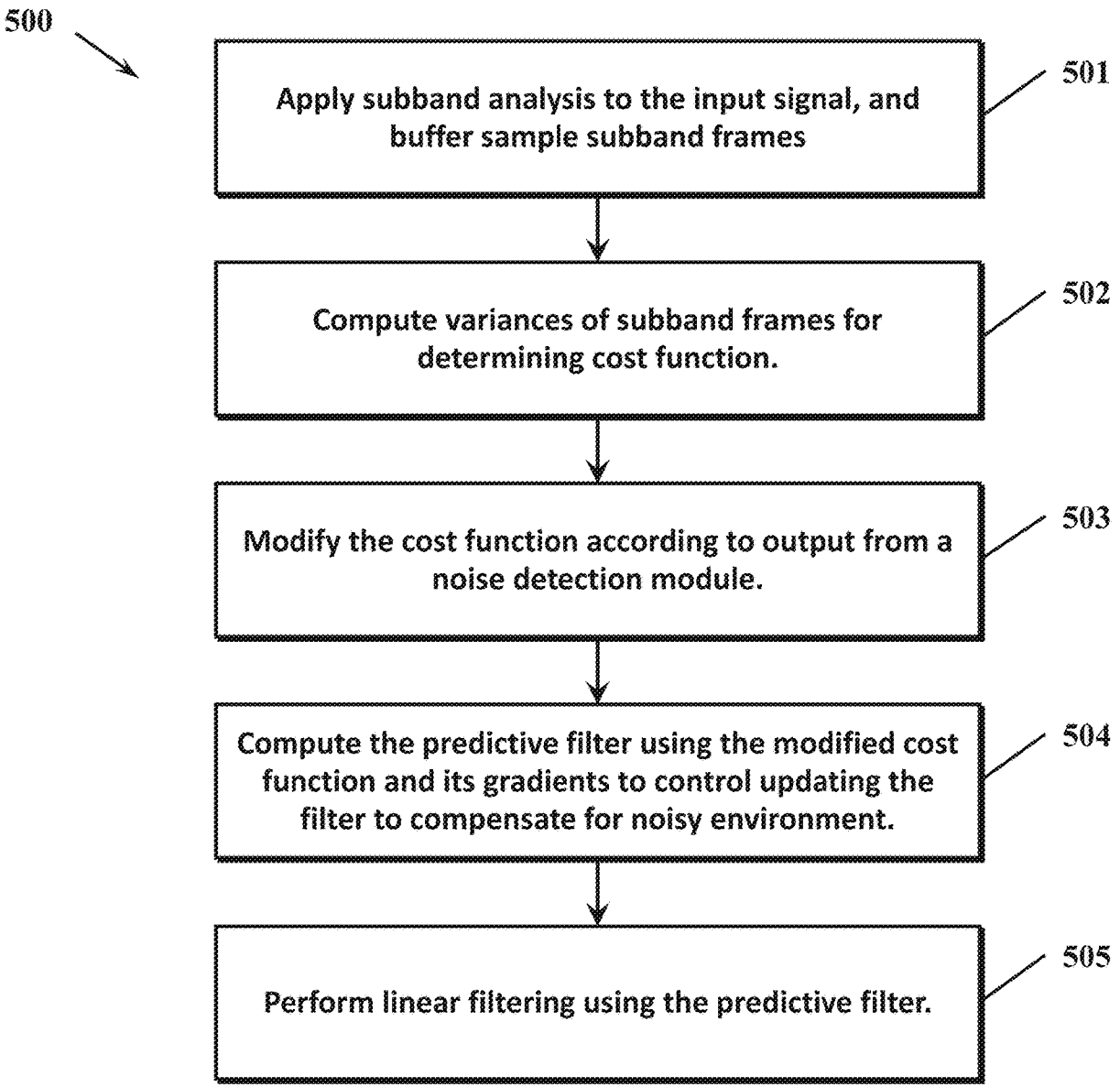
FIG. 5 is a flow diagram of a method of MIMO audio signal de-reverberation processing, using voice activity detection for noisy environments, according to an embodiment.

FIG. 5 is a flow diagram of a method 500 of MIMO audio signal de-reverberation processing, using voice activity detection for noisy environments, according to an embodiment. Method 500 may include an act 501 of applying subband analysis to the input signal 102, and buffering sample subband frames 112, as described above. Method 500 may include an act 502 of computing variances (e.g., as in equations (2) and (3)) of subband frames 112 for determining the cost function, e.g., as in equations (4) and (6). At act 503, the cost function may be modified according to output from a noise detection module, e.g., voice activity detector (VAD) 145 shown in FIG. 2.

In the case of noisy conditions, the prediction filter (e.g., $g_i^{(l)}(k)$) may not only concentrate on reverberation, but it may also target the quite stationary noise as well. In that case, the prediction filter, if unmodified from the above description, will be estimated to reduce both stationary noise and the reverberation. In some applications, however, it is not desired to let the prediction filter be estimated to cancel the noise as it is mainly designed to reduce the reverberation. In addition, in very non-stationary noisy conditions the prediction filter may try to track the noise, which can change quite fast and will not allow the LMS method to converge, ultimately decreasing its de-reverberation performance.

To improve the performance of the LMS method in that case, method 500 supervises the LMS filter adaptation by using an external voice activity detection (e.g., VAD 145). For example, the VAD 145 may be configured to produce a probability value between 0 and 1 that the target speech is active in the frame l. The probability value is indicated by w(l) in the following equations. The cost function (see equations (6)) is modified as:

$$\text{cost function} = L(X_i(l,k), l=1 \ldots T \mid g_m^i(l,k)) = \sum_{l=1}^{T}\left\{\log|\sigma(l,k)| + w(l)\left(\frac{\left|X_i(l,k)-\overline{X}(l,k)^T g_i^*(k)\right|^2}{\sigma(l,k)}\right)\right\}. \quad (12)$$

This modified cost function leads to the following modification for the gradient computation as:

$$\nabla(L(X_i(l,k))) = w(l)E(l,k)\overline{X}(l,k) \quad (13)$$

$$E(l,k) = \frac{X_i(l,k)-X(l,k)^T g_i^{(1-1)*}(k)}{\sigma(l,k)}.$$

Because the values of w(l) are less than 1.0, equations (13) show that method 500 can decrease the amount of update (see, e.g., equation (7)) in noisy frames or even skip them if the values of w(l) are very small. Thus, using the modified cost function and gradient at act 504, method 500 may compute the predictive filter to control updating the filter to compensate for noisy environments.

At act 505, the optimal filter weights may be passed to linear filter 150 and used to perform linear filtering of the subband frames 112, which are also passed to linear filter 150 as seen in FIG. 2.

Figure 6:
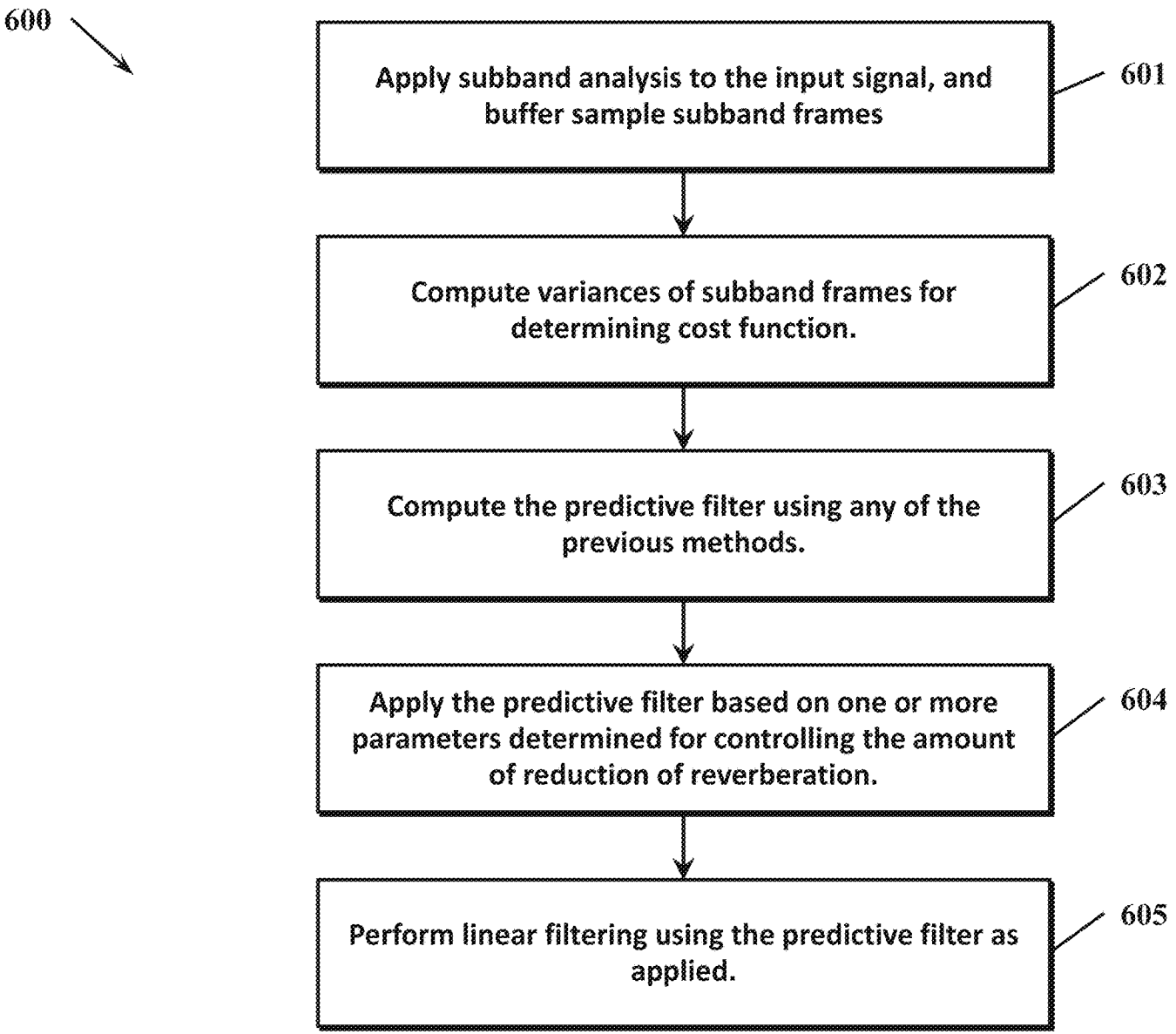
FIG. 6 is a flow diagram of a method of multiple input multiple output audio signal de-reverberation processing using a parameter to limit the reverberation reduction, according to an embodiment.

FIG. 6 is a flow diagram of a method 600 of MIMO audio signal de-reverberation processing using a parameter to limit the reverberation reduction, according to an embodiment. Method 600 may include an act 601 of applying subband analysis to the input signal 102, and buffering sample subband frames 112, as described above. Method 600 may include an act 602 of computing variances (e.g., as in equations (2) and (3)) of subband frames 112 for determining the cost function, e.g., as in equations (4) and (6). At act 603, the prediction filter may be estimated (e.g., predictive filter estimator 140 in FIG. 2) using any of the methods described. At act 604, after the estimation of the prediction filter, method 600 may perform the linear filtering by applying the predictive filter weights $g_i^{(l)}(k)$. The prediction filters may be estimated as discussed above, and the input signal in each channel may be filtered by the prediction filters as:

$$Y_i(l,k) = X_i(l,k) - \sum_{m=1}^{M}\sum_{l'=0}^{L_k-1} X_m(l-D-l',k)g_m^{i*(1-1)}(l',k), \tag{14}$$

as shown at linear filter 150 in FIG. 2.

For some applications like ASR or VoIP, performance may be enhanced by performing operations to limit the amount of reverberation reduction by a parameter. At act 604, the predictive filter may be applied at linear filter 150 based on one or more parameters determined for controlling the amount of reduction of reverberation. At act 605, linear filter 150 may perform the linear filtering under control of the one or more parameters. For example, linear filtering may be performed by linear filter 150 using one tuning parameter a to control the amount of de-reverberation using the following equations:

$$Y_i(l,k) = X_i(l,k) - \alpha R_i(l,k) \tag{15}$$

$$R_i(l,k)\sum_{m=1}^{M}\sum_{l'=0}^{L_k-1} X_m(l-D-l',k)g_m^{i*(l-1)}(l',k)$$

$$\alpha = \max\left(1, (1-\xi)\frac{P_x(l,k)}{\max(P_r(l,k),\varepsilon_r)}\right)$$

$$P_x(l,k) = \beta P_x(l-1,k) + (1-\beta)\sqrt{(X_i(l,k)X_i^*(l,k))}$$

$$P_r(l,k) = \beta P_r(l-1,k) + (1-\beta)\sqrt{(R_i(l,k)R_i^*(l,k))}$$

Both $P_r(l-1,k)$ and $P_x(l-1,k)$ are initilized by zero, where $\alpha$ is the tuning or control parameter to control the amount of reduction of reverberation or amount of de-reverberation, $\beta$ is a smoothing factor close to one, and $\varepsilon_r$ is a small value (e.g., 0.000001) to avoid division by zero.

Returning again to FIG. 2, following the linear filtering, as performed by any of the foregoing described methods, at linear filter 150, nonlinear filter 160 may perform nonlinear filtering as described in the co-pending application and by the following equation:

$$Z_i(l,k) = \frac{Y_i(l,k)\sigma^c(l,k)}{\sigma(l,k)}. \tag{16}$$

Following applying the nonlinear filtering 160, the enhanced speech spectrum for each band (e.g., $Z_i(l,k)$) may be transformed from the frequency domain to time domain by applying subband synthesis to produce time domain output $z_i[n]$, (i=1 . . . M) where M is the number of microphones. For example, as described above, nonlinear filter 160 may be applied to the output of linear filter 150, as shown, to reduce the residual reverberation and noise. Synthesizer 170 may be applied to the output of nonlinear filter 160, transforming the enhanced subband frequency domain signals to time domain signals.

Figure 7:
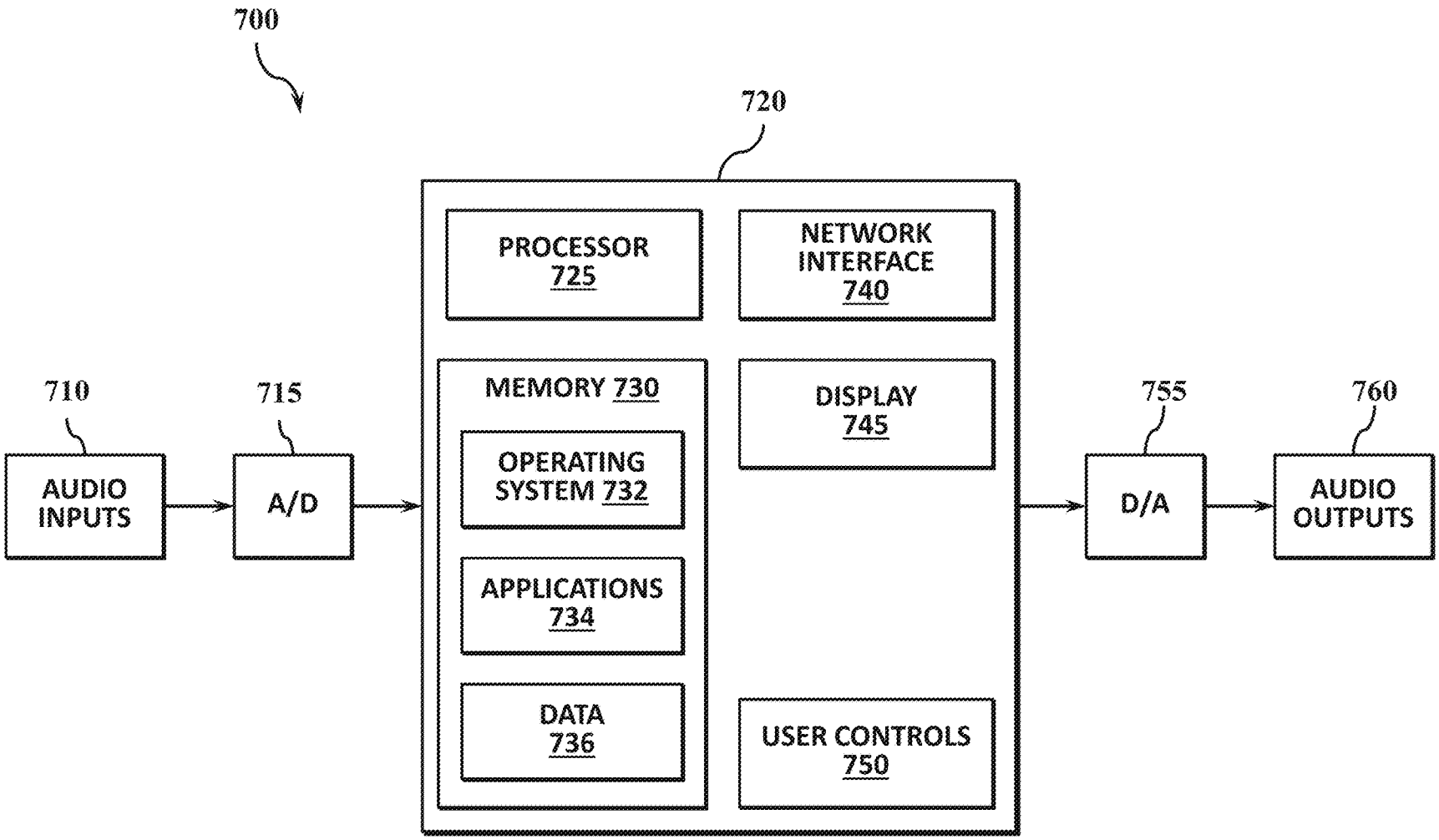
FIG. 7 is a block diagram of an example of a hardware system, in accordance with an embodiment.

As discussed, the various techniques provided herein may be implemented by one or more systems which may include, in some embodiments, one or more subsystems and related components thereof. For example, FIG. 7 illustrates a block diagram of an example hardware system 700 in accordance with one embodiment. In this regard, system 700 may be used to implement any desired combination of the various blocks, processing, and operations described herein (e.g., system 100, methods 400, 500, and 600). Although a variety of components are illustrated in FIG. 7, components may be added or omitted for different types of devices as appropriate in various embodiments.

As shown, system 700 includes one or more audio inputs 710 which may include, for example, an array of spatially distributed microphones configured to receive sound from an environment of interest. Analog audio input signals provided by audio inputs 710 are converted to digital audio input signals by one or more analog-to-digital (A/D) converters 715. The digital audio input signals provided by analog-to-digital converters 715 are received by a processing system 720.

As shown, processing system 720 includes a processor 725, a memory 730, a network interface 740, a display 745, and user controls 750. Processor 725 may be implemented as one or more microprocessors, microcontrollers, application specific integrated circuits (ASIC), programmable logic devices (PLD)—e.g., field programmable gate arrays (FPGA), complex programmable logic devices (CPLD), field programmable systems on a chip (FPSC), or other types of programmable devices—codecs, or other processing devices.

In some embodiments, processor 725 may execute machine readable instructions (e.g., software, firmware, or other instructions) stored in memory 730. In this regard, processor 725 may perform any of the various operations, processes, and techniques described herein. For example, in some embodiments, the various processes and subsystems described herein (e.g., system 100, methods 400, 500, and 600) may be effectively implemented by processor 725 executing appropriate instructions. In other embodiments, processor 725 may be replaced or supplemented with dedicated hardware components to perform any desired combination of the various techniques described herein.

Memory 730 may be implemented as a machine readable medium storing various machine readable instructions and data. For example, in some embodiments, memory 730 may store an operating system 732 and one or more applications 734 as machine readable instructions that may be read and executed by processor 725 to perform the various techniques described herein. Memory 730 may also store data 736 used by operating system 732 or applications 734. In some embodiments, memory 720 may be implemented as non-volatile memory (e.g., flash memory, hard drive, solid state drive, or other non-transitory machine readable media), volatile memory, or combinations thereof.

Network interface 440 may be implemented as one or more wired network interfaces (e.g., Ethernet) or wireless interfaces (e.g., WiFi, Bluetooth, cellular, infrared, radio) for communication over appropriate networks. For example, in some embodiments, the various techniques described herein may be performed in a distributed manner with multiple processing systems 720.

Display 745 presents information to the user of system 700. In various embodiments, display 745 may be implemented, for example, as a liquid crystal display (LCD) or an organic light emitting diode (OLED) display. User controls 750 receive user input to operate system 700 (e.g., to provide user-defined parameters as discussed or to select operations performed by system 700). In various embodiments, user controls 750 may be implemented as one or more physical buttons, keyboards, levers, joysticks, mice, or other physical transducers, graphical user interface (GUI) inputs, or other controls. In some embodiments, user controls 750 may be integrated with display 745 as a touchscreen, for example.

Processing system 720 provides digital audio output signals that are converted to analog audio output signals by one or more digital-to-analog (D/A) converters 755. The analog audio output signals are provided to one or more audio output devices 760 such as one or more speakers, for example. Thus, system 700 may be used to process audio signals in accordance with the various techniques described herein to provide improved output audio signals with improved speech recognition.

Where applicable, various embodiments provided by the present disclosure may be implemented using hardware, software, or combinations of hardware and software. Also, where applicable, the various hardware components and/or software components set forth herein may be combined into composite components comprising software, hardware, and/or both without departing from the spirit of the present disclosure. Where applicable, the various hardware components and/or software components set forth herein may be separated into sub-components comprising software, hardware, or both without departing from the scope of the present disclosure. In addition, where applicable, it is contemplated that software components may be implemented as hardware components and vice-versa.

Software, in accordance with the present disclosure, such as program code and/or data, may be stored on one or more computer readable mediums. It is also contemplated that software identified herein may be implemented using one or more general purpose or specific purpose computers and/or computer systems, networked and/or otherwise. Where applicable, the ordering of various steps described herein may be changed, combined into composite steps, and/or separated into sub-steps to provide features described herein.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. A method comprising:

receiving, by a plurality of microphones, audio from an environment, and generating a corresponding plurality of audio signals;

performing a subband analysis to transform each of the plurality of audio signals from time domain to frames of under-sampled K-subband frequency domain signals;

buffering, with a delay, a number $L_k$ of frames for each of the plurality of frequency domain signals;

estimating online a prediction filter at each frame using an adaptive method for online convergence, wherein the adaptive method comprises using a least mean squares (LMS) process to estimate the prediction filter at each frame independently for each subband by adaptively estimating a step size for the LMS process based at least in part on an LMS cost function to control a convergence rate of the LMS process;

performing a linear filtering on each of the under-sampled K-subband frequency domain signals using the corresponding estimated prediction filters to reduce reverberation; and applying a subband synthesis to reconstruct each of the under-sampled K-subband frequency domain signals to time-domain signals corresponding to each of the plurality of audio signals.

2. The method of claim 1, further comprising:

estimating a variance $\sigma(l,k)$ of the frequency-domain signals for each frame and subband; and following the linear filtering, applying a nonlinear filtering using the estimated variance to reduce residual reverberation and noise after the linear filtering.

3. The method of claim 2, wherein estimating the variance comprises estimating a variance of reflections, a reverberation component variance, and a noise variance.

4. The method of claim 3, comprising:

estimating the variance of reflections using a previously estimated prediction filter;

estimating the reverberation component variance using a fixed exponentially decaying weighting function with a tuning parameter to optimize the prediction filter by application; and estimating the noise variance using a single-microphone noise variance estimation for each audio signal.

5. The method of claim 1, wherein the linear filtering is performed under control of a tuning parameter to adjust an amount of de-reverberation.

6. The method of claim 1, wherein adaptively estimating the step size is based, at least in part, on a gradient of an LMS cost function and improves a convergence rate of the LMS process compared to using a fixed step-size.

7. The method of claim 1, wherein the adaptive method comprises using voice activity detection to control the update of the prediction filter under noisy conditions.

8. The method of claim 1, wherein the time-domain signals corresponding to each of the plurality of audio signals represent a time differences of arrival at each of the corresponding plurality of microphones.

9. An audio signal processing system comprising:

a hardware system processor and a non-transitory system memory, the system processor and system memory comprising:

a subband analysis module configured to transform a multi-channel audio signal received from a plurality of microphones, each microphone corresponding to one of a plurality of channels, from time domain to frequency domain as subband frames;

a buffer, having a delay configured to store for each channel a number of frames for each subband of each of the plurality of channels;

a prediction filter configured to blindly estimate in online manner an estimated prediction filter at each subband frame using an adaptive method, wherein the adaptive method comprises using a least mean squares (LMS) process to estimate the prediction filter at each subband frame independently by adaptively estimating a step size for the LMS process based at least in part on a gradient of an LMS cost function;

a linear filter configured to apply the estimated prediction filter to a current subband frame; and a subband synthesizer configured to, for each of the plurality of channels, reconstruct the frequency domain signals from the current subband frame into a time-domain de-reverberated enhanced output signal, wherein each of the time-domain de-reverberated signals corresponds to one of the plurality of microphones.

10. The system of claim 9, further comprising a variance estimator configured to estimate a variance of the frequency-domain signals for each frame and subband; and a nonlinear filter configured to apply a nonlinear filter based on the estimated variance following the linear filtering of the current subband frame.

11. The system of claim 10, wherein estimating the variance comprises estimating a variance of early reflections, a reverberation component variance, and a noise variance.

12. The system of claim 9, wherein the linear filter is configured to operate under control of a tuning parameter that adjusts an amount of de-reverberation applied by the estimated prediction filter to the current subband frame.

13. The system of claim 11, wherein estimating the variance of early reflections comprises using a previously estimated prediction filter;

estimating the reverberation component variance comprises using a fixed exponentially decaying weighting function with a tuning parameter; and estimating the noise variance comprises using a single-microphone noise variance estimation for each channel.

14. The system of claim 9, wherein the adaptive method comprises using an adaptive step-size estimator that improves a convergence rate of LMS compared to using a fixed step-size estimator.

15. The system of claim 9, wherein the adaptive method comprises using a voice activity detector to control the update of the prediction filter.

16. A system comprising:

a non-transitory memory storing one or more subband frames, wherein each subband frame, of the one or more subband frames, corresponds to a frequency bin, wherein the frequency bin corresponds to a subband frequency domain signal, wherein the subband frequency domain signal corresponds to transformed multi-channel audio signals produced by a microphone on one channel of a plurality of channels; and one or more hardware processors in communication with the memory and configured to execute instructions to cause the system to perform operations comprising:

estimating a prediction filter online at each subband frame using an adaptive method of least mean squares (LMS) estimation by adaptively estimating a step size for the LMS process based at least in part on a corresponding LMS cost function;

performing a linear filtering on the subband frames using the estimated prediction filter; and applying a subband synthesis to reconstruct the subband frames into time-domain signals on a plurality of channels.

17. The system of claim 16, wherein the adaptive method comprises using an adaptive step-size estimator.

18. The system of claim 16, wherein adaptively estimating a step size for the LMS process is based on values of a gradient of the LMS cost function.

19. The system of claim 18, wherein the step size varies inversely to an average of values of a gradient of the LMS cost function.

* * * * *